United States Patent [19]

Thurston

[11] 4,363,310

[45] Dec. 14, 1982

[54] DIESEL ENGINE WITH BLOWBY SCAVENGING

[75] Inventor: Kelly W. Thurston, Okemos, Mich.

[73] Assignee: General Motors Corporation, Detroit, Mich.

[21] Appl. No.: 234,637

[22] Filed: Feb. 17, 1981

Related U.S. Application Data

[63] Continuation-in-part of Ser. No. 165,712, Jul. 3, 1980, abandoned.

[51] Int. Cl.[3] ..... F02B 33/00

[52] U.S. Cl. ..... 123/572; 123/573; 123/41.86

[58] Field of Search ..... 123/572, 573, 574, 41.86

[56] References Cited

U.S. PATENT DOCUMENTS

| | | | |
|---|---|---|---|
| 1,042,888 | 10/1912 | Butsch | 123/41.86 |
| 1,642,494 | 9/1927 | Hartzell | 123/572 |
| 1,846,282 | 2/1932 | Summers . | |
| 2,185,254 | 1/1940 | Kliesrath . | |
| 2,224,229 | 10/1940 | Miller | 123/41.86 |
| 2,497,781 | 2/1950 | Logashkin | 123/41.86 |
| 2,963,006 | 12/1960 | Karde . | |
| 3,875,914 | 4/1975 | Villedella . | |
| 4,256,064 | 3/1981 | Thorn | 123/572 |

*Primary Examiner*—Ronald H. Lazarus
*Attorney, Agent, or Firm*—Robert J. Outland

[57] ABSTRACT

In preferred embodiments, the pistons of a 4-stroke cycle diesel engine are provided with blowby storage chambers between two upper piston rings and a scavenging system to flush out blowby gases from the storage chambers when the pistons are at or near their bottom positions of piston motion. The scavenged blowby gas is recirculated to the engine induction system or may be conducted directly to the associated combustion chambers. The system reduces contamination of the engine lubricating oil with sooty particulates and other products in the blowby gases.

5 Claims, 8 Drawing Figures

DIESEL ENGINE WITH BLOWBY SCAVENGING

RELATED APPLICATION

This is a continuation-in-part of United States patent application Ser. No. 165,712, filed July 3, 1980 now abandoned.

TECHNICAL FIELD

This invention relates to diesel engines and more particularly to the scavenging and recirculation of blowby gases to reduce contamination of the lubricating oil with sooty particulates and the like.

BACKGROUND

In recent years, there has been a considerable increase in the use of diesel engine powered automobiles because of their known advantage over gasoline powered vehicles in fuel consumption, i.e. the ability to provide more miles of vehicle travel for each gallon of fuel consumed. In view of this significant benefit and the anticipated increasing cost of engine fuels in the foreseeable future, it is expected that further significant increases in the use of diesel engines in automobiles and light commercial vehicles will be made during at least the next few years.

However, diesel engines, particularly those of the 4-stroke cycle indirect injection (prechamber) type most commonly used in automobiles and lightweight commercial vehicles, also have certain characteristics that are less favorable than those of comparable gasoline powered engines. Among these is the formation in the combustion products of carbonaceous (sooty) particulates some of which are carried with blowby gases past the pistons and piston rings into the engine crankcase and oil sump with resulting contamination of the engine lubricating oil.

Studies have indicated that diesel soot contamination has an adverse effect on certain wear-resisting additives utilized in automotive engine lubricating oils and, accordingly, the amount of soot contamination which can be accommodated in the lubricating oil charge is limited. As a result in some designs of automotive diesel engines, it has been necessary to replace the charge of lubricating oil approximately every 3,000 miles of vehicle operation as compared to a comparable oil change interval for gasoline powered vehicles of 7,500 miles. For this reason, as well as others, it is desirable to find some way of reducing the amount of particulate contamination of the lubricating oil which normally occurs during operation of automotive diesel engines.

SUMMARY OF THE INVENTION

The present invention provides means in a diesel engine for scavenging blowby products from the engine cylinders and pistons and recirculating them to the engine combustion chambers for reburning or exhaust before they have a chance to enter and contaminate the lubricating oil in the engine crankcase and oil sump. The invention involves the provision of suitable storage volumes around the engine pistons between their compression and oil control rings. These are combined with means for scavenging these storage volumes, preferably when the associated pistons are at or near the bottoms of their respective reciprocating motions or strokes.

The scavenging system may include an air supply pump connected with supply passages into the engine cylinders which communicate with the blowby storage volumes near the bottoms of piston motion and discharge passages that carry the scavenged blowby products either to the engine induction system or directly to the combustion chambers. The supply and discharge passages are located so that they are blocked by the piston skirts during most portions of piston motion when they are not connected with their associated blowby storage volumes for recirculating blowby gases. In this way, substantial amounts of blowby products are prevented from contaminating the engine lubricating oil by their collection and recirculation to the engine combustion chambers for reburning or disposal. If desired, the blowby particulates could be directly disposed of by conduction of the blowby gases to suitable diposal or collection means such as a filter or other particulate trap.

These and other features of the invention will be more fully understood from the following description of certain preferred embodiments taken together with the accompanying drawings.

BEST MODE DISCLOSURE

Figure 1:
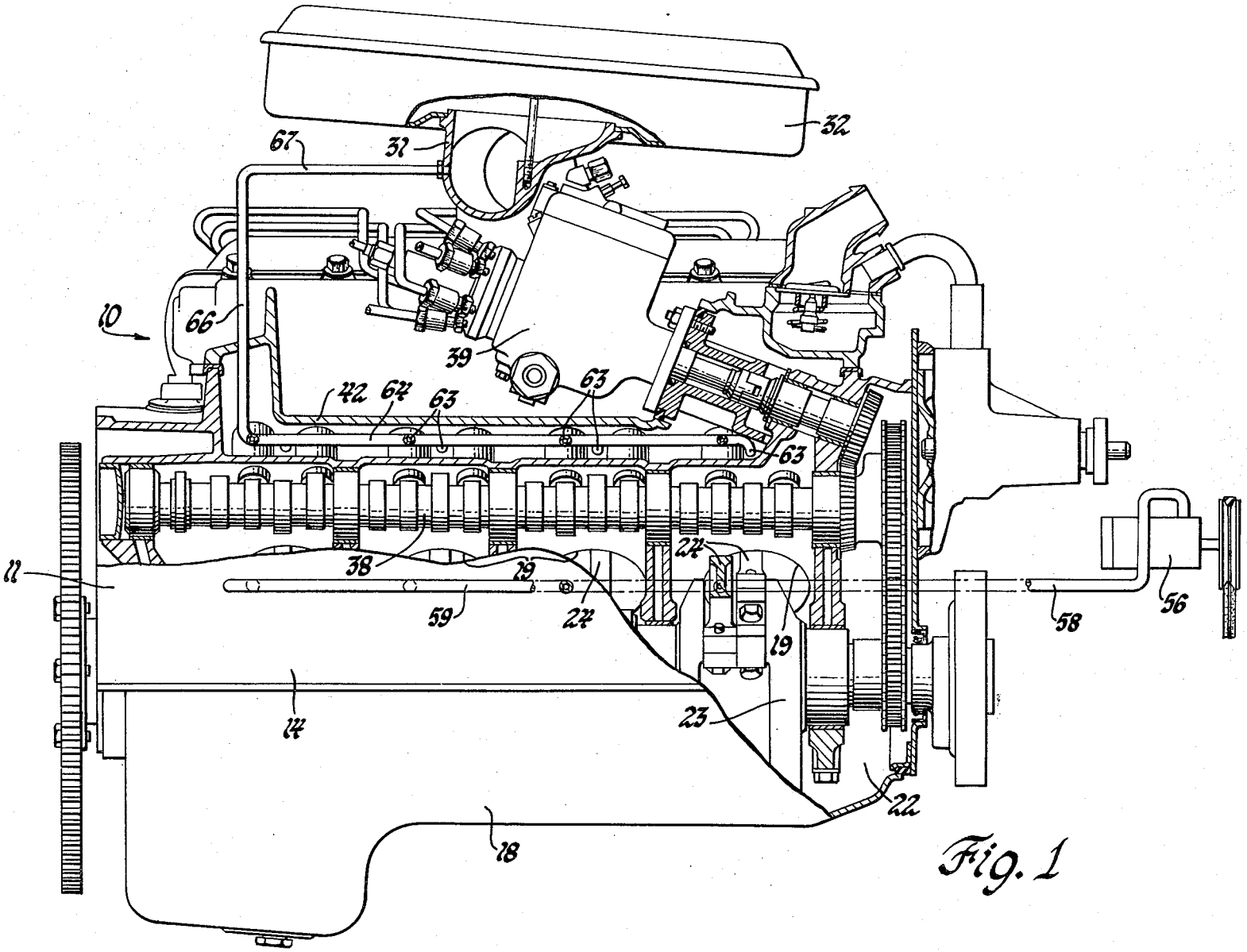
FIG. 1 is a side view of an automotive diesel engine having portions broken away to show features of the blowby scavenging means incorporated in accordance with the invention.
Figure 2:
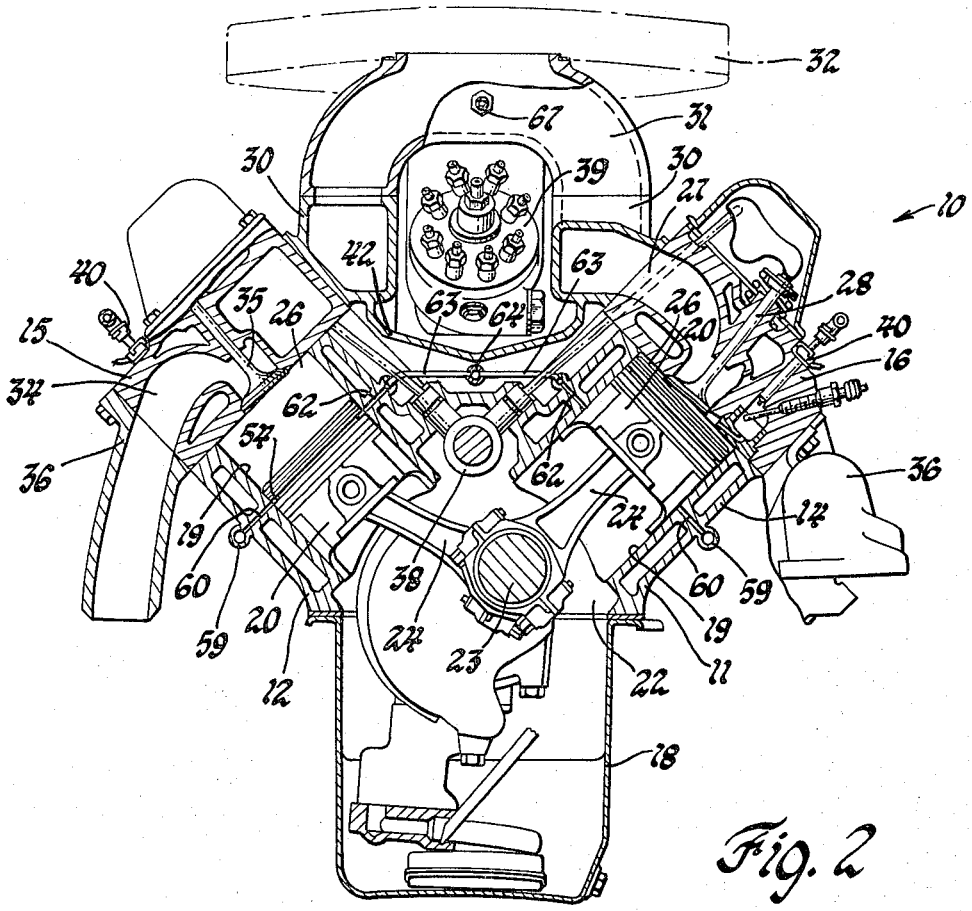
FIG. 2 is a transverse cross-sectional view of the engine of FIG. 1 showing further features of the blowby scavenging means.
Figure 3:
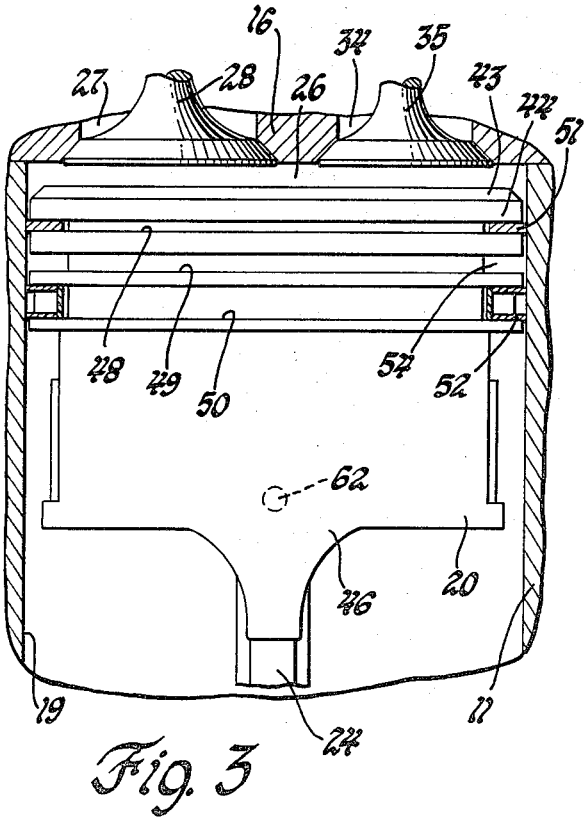
FIG. 3 is an enlarged fragmentary cross-sectional view of a portion of one cylinder of the engine showing the piston near the upper position of its reciprocating motion and illustrating certain construction features of the piston and cylinder.
Figure 4:
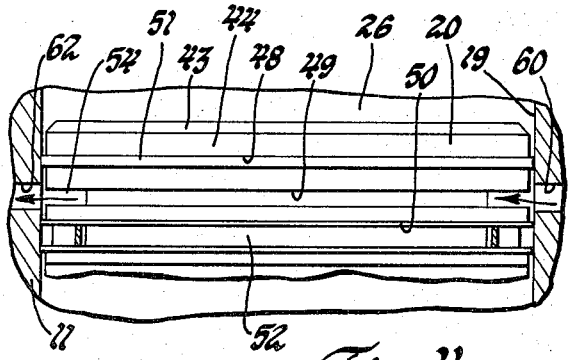
FIG. 4 is a fragmentary cross-sectional view through another cylinder of the engine showing the piston near the bottom position of its reciprocating motion and illustrating further features of the blowby scavenging means.

Referring now to the drawings in detail. Numeral 10 generally indicates an automotive diesel engine of the 4-stroke cycle indirect injection (pre-chamber) type. Engine 10 is provided with a cylinder block 11 defining a pair of cylinder banks 12, 14 on which are conventionally mounted cylinder heads 15, 16 respectively. The open bottom of the cylinder block is closed by an oil pan 18 which defines a sump in which lubricating oil is stored and from which it is drawn for lubricating the engine.

In each of the engine cylinder banks, the cylinder block defines a plurality of cylinders 19 in which are reciprocably disposed pistons 20. The lower ends of the cylinders are open above the oil sump to a crankcase 22 in which is rotatably mounted a crankshaft 23 that is conventionally connected by connecting rods 24 to the pistons of the respective cylinders. The upper ends of the cylinders opposite the crankcase are closed by the cylinder heads 15, 16 which, together with the pistons and cylinders, define variable volume combustion chambers 26 at the cylinder's closed ends.

Charging air is supplied to the combustion chambers of the various engine cylinders through an induction system that includes inlet ports 27 in the cylinder heads controlled by inlet poppet valves 28 and connecting with intake manifolds 30 fed by a crossover conduit 31 that supports an intake air cleaner 32. An exhaust system is also provided for exhausting residual products from the combustion chambers including exhaust ports 34 in the cylinder heads controlled by exhaust poppet valves 35 and connecting with exhaust manifolds 36 mounted on the sides of the cylinder heads.

The valves are conventionally actuated through valve gear driven by a camshaft 38 mounted between the cylinder banks and drivingly connected with the engine crankshaft. The camshaft also drives an injection pump 39 mounted on the cylinder block and connecting with individual injectors 40 which supply fuel to the respective cylinders. A valley cover 42, formed integrally with the intake manifolds 30, extends between the cylinder banks 12, 14, covering the lubricated camshaft and valve train area below and preventing mixing of the lubricating oil contained therein with the atmosphere and contaminants external to the engine.

Each of the engine pistons 20 is formed with a closed end 43 having an adjacent ring belt 44 and a skirt 46 below the ring belt and engaging the walls of the cylinder to absorb thrust loads and act as a bearing for reciprocating motion for the piston within the cylinder.

The piston ring belt is provided with first, second and third grooves 48, 49, 50 respectively. In the first groove 48, is disposed a conventional piston compression seal ring 51 which engages the walls of the cylinder 19 to limit to the extent possible the escape of pressurized charging and combustion gases from the associated combustion chamber 26 into the crankcase and oil sump below. In the thid ring groove 50, is disposed a conventional oil control seal ring 52 which engages the walls of the cylinder for the primary purpose of scraping lubricating oil downwardly on the cylinder walls toward the oil sump and preventing the escape of excess oil upwardly into the combustion chamber 26 above.

The second groove 49, together with the adjacent clearance space around the piston between the compression and oil control seal rings, forms a blowby storage volume 54. Blowby gases, including products of combustion and their entrained sooty particulates which escsape from the combustion chamber past the compression ring 51, are collected in the storage volume 54 and are in substanial part retained temporarily by the adajcent seal rings and the associated walls of the piston and cylinder.

The engine 10 is further provided with blowby scavening means which include an air pump 56 which may be of any suitable type and is preferably mounted externally and driven as an accessory by a belt through means, not shown, connected with the engine crankshaft. Air pump 56 is connected by conduits 58 with a pair of inlet air manifolds 59 on either side of the cylinder block. Manifolds 59 are in turn connected through restricted air supply passages 60 with respective cylinders 19 at points which connect with their blowby storage volumes 54 when the pistons are at or near their bottom positions of piston travel.

At the same axial locations but on opposite sides from the air supply passages, the cylinders are provided with gas discharge passages 62, which extend through the inner cylinder block walls and connect by means of jumper lines 63 with a longitudinally disposed central discharge manifold 64. Manifold 64 is in turn connected by conduits 66, 67 with the interior of the crossover conduit 31 that form a part of the engine induction system.

In operation, blowby gases containing entrained sooty particulates which escape from the engine combustion chambers past the compression seal rings 51 are collected in the blowby storage volumes 54 formed by the second grooves 49 and the adjacent clearance volumes surrounding the pistons. When the pistons are above the lower portions of their strokes, the skirt portions 46 substantially block the associated air supply and discharge passages 60, 62 respectively, preventing significant gas flow therethrough. However, when the pistons move downwardly to points near the bottom position of their piston motion, passages 60 and 62 in the walls of the cylinders communicate with the blowby storage volumes 54 in the spaces between the seal rings 51 and 52. When this occurs, pressurized air supplied by the air pump 56 forces the accumulated blowby gases from the blowby storage volumes with charges of scavenging air, forcing the blowby gases through the discharge system, including passages 62, jumper line 63, manifold 64 and conduits 66 and 67, to the interior of the crossover conduit 31 of the engine induction system. Here the blowby gases mix with the engine induction air and are carried through the induction system to the various engine combustion chambers for recombustion and exhaust.

It should be apparent that the blowby storage volumes largely defined by the second piston grooves 49 may be formed of any appropriate size and shape possible within the limited space provided. The grooves are preferably sized to best accommodate the desired purposes of maximizing the recirculation of blowby gases which escape past the compression seal rings without unduly increasing the volume of such escaped gases. In addition, the storage volume should be sufficiently small so as not to require scavenging air flow which is excessive either in the amount of power required to drive the air pump or in view of the limited time available for the admission of scavenging air during the dwell portion of the pistons at the bottoms of their piston strokes.

Figure 5:
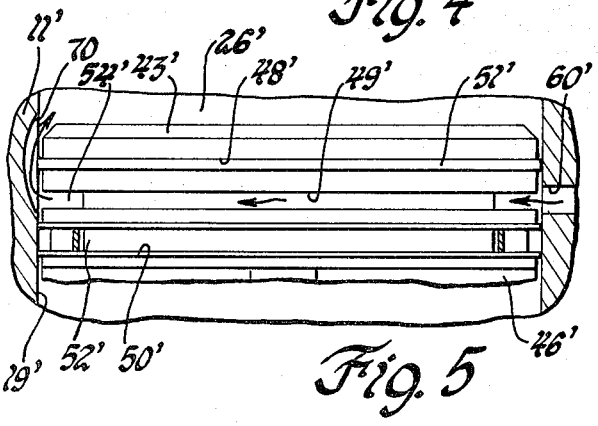
FIG. 5 is a fragmentary cross-sectional view similar to FIG. 4 illustrating features of an alternative embodiment of blowby scavenging means in accordance with the invention.

Referring now to FIG. 5 of the drawings, there is shown an alternative embodiment of diesel engine blowby scavenging system which is similar to that previously described except with respect to the recirculation of blowby gases from each cylinder to its respective combustion chamber. In the arrangement of FIG. 5, the storage volume 54' communicates near the lower portion of the piston stroke with a longitudinal groove 70 that is formed in the wall of the cylinder 19'. Groove 70 extends upwardly, bypassing the compression seal ring 51' and communicating the blowby storage volume 54' directly with its respective combustion chamber 26' when the piston is at or near the bottom position of its travel. In this position, scavenging air admitted through the air supply passage 60' scavenges collected blowby gases from the storage volume 54' out through the discharge groove 70 and directly into the combustion chamber 26'.

In this way, blowby gases and their entrained particulates are recycled directly to the associated engine combustion chamber each time the piston approaches the bottom of its stroke. Movement of the piston to positions above its bottom position allows the piston skirt 46' to cover, and block flow through, the air supply passage 60' and the discharge groove 70. In other respects, the embodiment of FIG. 5 is similar to that described with respect to FIGS. 1 through 4.

Figure 6:
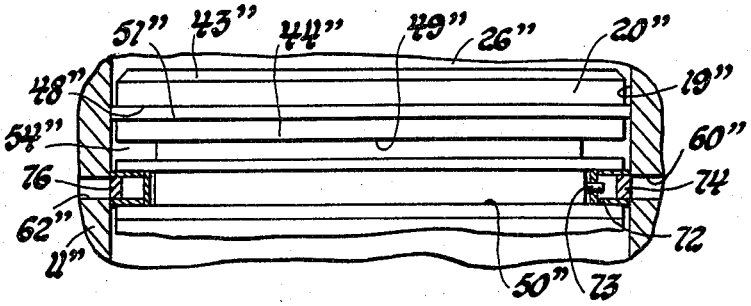
FIG. 6 is a fragmentary cross-sectional view similar to FIGS. 4 and 5 but illustrating features of still another alternative embodiment of blowby scavenging means in accordance with the invention.

In FIG. 6 of the drawings, there is shown a modified embodiment of blowby scavenging system similar to that of FIGS. 1–4 except for changes in the structure of the oil control seal ring 72 disposed in the third groove 50". In this embodiment, the oil ring 72 is fixed in nonrotating relation in the third ring groove 50" by means of a pin 73 for other suitable means keying the ring 72 to the piston 20". A pair of inserts 74, 76 are fixed between the rails of the oil ring 72 at diametrically opposite locations aligned respectively with the air supply and gas discharge passages 60", 62".

In operation, as the piston moves so that the third ring groove 50" is in alignment with the passages 60", 62' as shown in FIG. 6, the inserts 74, 76 block the passage openings and prevent the flow of scavenging air through the third ring groove and the ventilated oil ring 72 therein. This blockage of air flow through the oil ring groove is desirable in that it prevents the scavenging air flow from carrying oil collected within the groove out through the discharge passage 62" as may occur in constructions where an unblocked oil ring construction is utilized, as is the case in the embodiments of FIGS. 1–5.

Figure 7:
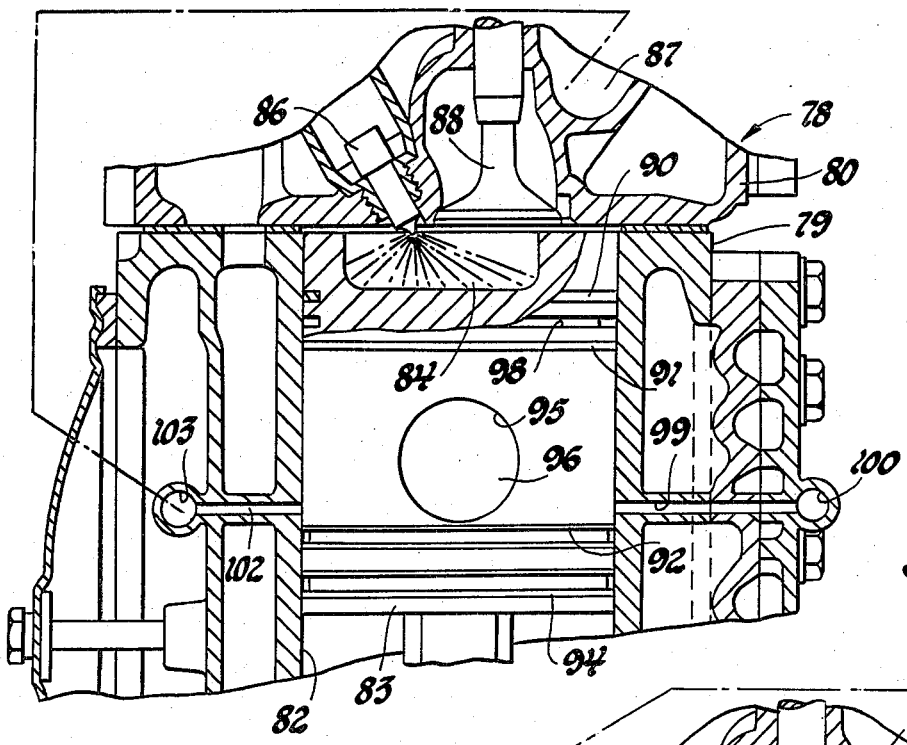
FIG. 7 is a fragmentary cross-sectional view of a portion of one cylinder of an alternative embodiment of automotive diesel engine having blowby scavenging means in accordance with the invention and showing the piston near the upper position of its reciprocating motion and FIG. 8 is a fragmentary cross-sectional view through another cylinder of the engine of FIG. 7 showing the piston near the bottom position of its reciprocating motion and illustrating further features of the blowby scavenging means.
Figure 8:
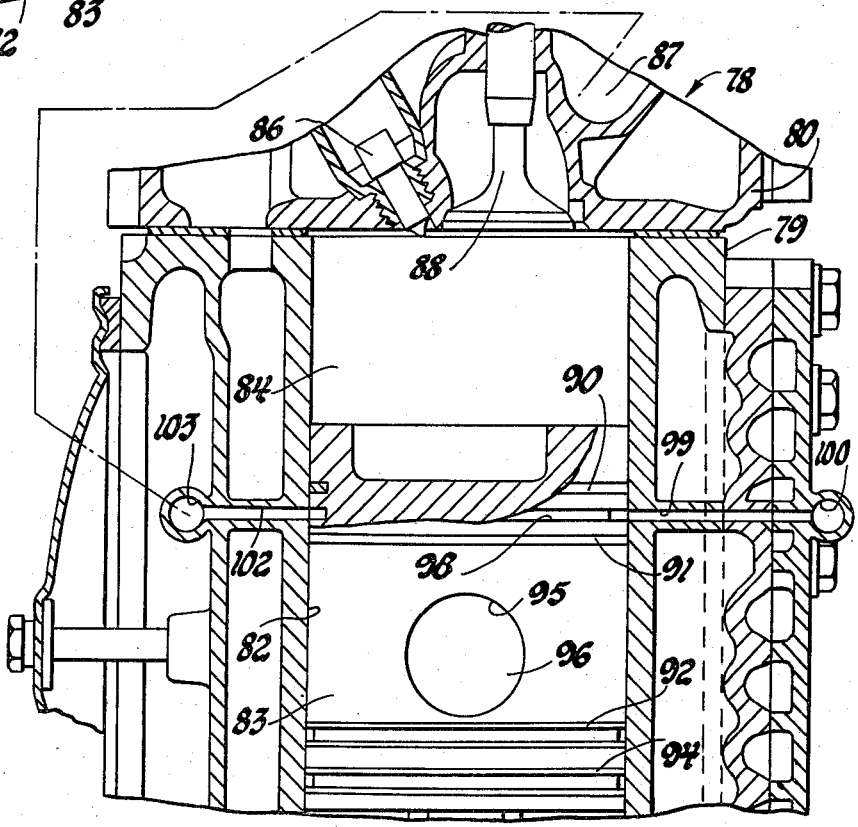

Referring now to FIGS. 7 and 8, there is shown another embodiment of diesel engine 78 having a cylinder block 79 with a cylinder head 80 seated on an upper surface thereof and an oil pan, not shown, mounted on a lower surface. The cylinder block defines a plurality of cylinders 82 which are open at the bottom to a crankcase, not shown, closed at the bottom by the associated oil pan. The cylinders contain pistons 83 which are conventionally arranged for reciprocation and define at their upper ends, together with the cylinders and cylinder head, combustion chambers 84. The cylinder head is provided with fuel injection means 86 to supply fuel to the combustion chambers, intake ports 87 and associated intake valves 88 to admit air to the combustion chambers and exhaust ports and associated exhaust valves, not shown, to provide for the exhaust of burned products from the combustion chambers.

In each cylinder, the leakage of blowby gases past the piston is controlled by the provision of suitable split compression rings 90, 91 received in spaced grooves on the piston and engaging the cylinder walls in conventional fashion. In like manner, the passage of lubricating oil up the cylinder walls to the combustion chamber is controlled by the provision of oil rings 92, 94 in spaced grooves located near the bottom of the piston skirt and engaging the walls of the cylinder. An opening 95 for a piston pin, not shown, located axially between the compression rings and the oil control rings has closure plates 96 on its ends to prevent the escape of oil from the interior of the piston onto the cylinder wall above the location of the oil control rings.

In accordance with the invention, the piston is provided with an open groove 98 between the upper and lower compression rings 90, 91 which provides an accumulator for blowby gases leaking past the top piston ring 90. At the bottom of piston travel, groove 98 is aligned with an air supply passage 99 that connects with an air supply manifold 100. On the opposite side of the cylinder, the groove 98 is aligned at the bottom position of piston travel with a gas discharge passage 102 that connects with a gas discharge manifold 103. Manfiold 103 connects through means not shown with the engine intake system and the connecting intake ports 87 of the various cylinders, while the supply manifold 100 is connected with a suitable low pressure air pump, not shown, preferably driven by the engine.

In operation, the compression and burning of a combustible charge in the combustion chambers causes some blowby gases to escape past the top piston ring and to collect in the space between the compression rings primarily in the accumulator volume provided by the open groove 98. When the piston moves downwardly to the bottom position of its travel as shown in FIG. 8, pressurized air from the manifold 100 is delivered through the passage 99 to the groove 98 to scavenge the blowby products out of the accumulator groove 98 into the dischage passage 102 and manifold 103. The scavenged blowby products are then returned to the engine inlet for delivery to the cylinders with their respective new air charges for reburning.

The relative position of the oil rings on the piston skirt is such that they are located below the position of the air supply and gas discharge. passages at the top position of piston motion shown in FIG. 7. Thus, at no time is there a tendency for scavenging air to be directed through the oil ring grooves and to carry lubricating oil from the engine cylinders into the engine air intake. For this reason, the arrangement of FIGS. 7 and 8 is considered preferable to that of FIGS. 1–6 in which some tendency for oil carry-over to the engine inlet obtains.

While the invention has been described by reference to certain preferred embodiments chosen for purposes of illustration, it should be recognized that numerous changes could be made in the details disclosed without departing from the spirit and scope of the inventive concepts described. Accordingly, it is intended that the invention not be limited by the illustrated embodiments but that it have the full scope permitted by the language of the following claims.

The embodiments of the invention in which an exclusive property or privilege is claimed are defined as follows:

1. In a diesel engine of the type having a cylinder with closed and open ends, a piston reciprocable in the cylinder and defining therewith a variable volume combustion chamber at the cylinder closed end, means at the cylinder closed end for admitting charging fluids to and exhausting residual products from the combustion chamber, a lubricant chamber at the open end of the cylinder, the piston having a skirt bearing on the cylinder under side thrust loading, and at least two spaced sealing rings on the piston and engaging the cylinder to limit the passage of combustion blowby products and lubricant from their respective chambers to the other, at least the top one of said sealing rings being located between the skirt and the combustion chamber end of the piston, and the improvement comprising an annular recess around the piston between the skirt and said top sealing ring, said recess comprising a blowby storage space of volume sufficient to collect a substantial amount of the blowby gases which escape from the combustion chamber past the top one of said sealing rings during each cycle of piston reciprocating motion, and blowby scavening means intermittently communicating with said recess to carry away blowby gases collected therein and thereby reduce contamination of the lubricant with particulates from the combustion products, said blowby scavenging means including an air supply passage in the cylinder and positined to communicate with the piston recess near the bottom position of piston motion and to be closed by the pistion skirt during other portions of the piston motion.

2. In a diesel engine of the type having acylinder with closed and open ends, a piston reciprocable in the cylinder and defining therewith a variable volume combustion chamber at the cylinder closed end, means at the cylinder closed end for admitting charging fluids to and exhausting residual products from the combustion chamber, a lubricant chamber at the open end of the cylinder, the piston having a skirt bearing on the cylinder under side thrust loading, and at least two spaced sealing rings on the piston and engaging the cylinder to limit the passage of combustion blowby products and lubricant from their respective chambers to the other, at least the top one of said sealing rings being located between the skirt and the combustion chamber end of the piston, and the improvement comprising an annular recess around the piston between the skirt and said top sealing ring, said recess comprising a blowby storage space of volume sufficient to collect a substantial amount of the blowby gases which escape from the combustion chamber past the top one of said sealing rings during each cycle of piston reciprocating motion, and blowby scavenging means intermittently communicating with said recess to carry away blowby gases collected therein and thereby reduce contamination of the lubricant with particulates from the combustion products, said blowby scavenging means including an air supply passage in the cylinder and positioned to communicate with the piston recess near the bottom position of piston motion and to be closed by the piston skirt during other portions of the piston motion, at least the bottom one of said sealing rings being an oil control ring located on the piston skirt below the position of said air supply passage at the top position motion to avoid passing scavenging air through the oil ring groove and any resultant oil carryover.

3. The combination of claim 1 or 2 wherein the blowby scavenging means further includes a gas discharge passage opening through the cylinder opposite the air supply passage and communicating with the engine induction system to recirculate to the engine intake blowby gases received from the blowby storage space between the seal rings near the bottom position of piston motion, said discharge passage also being closed by the piston skirt during other portions of the piston motion.

4. The combination of claim 1 or 2 wherein the blowby scavenging means further includes a gas discharge passage in the cylinder wall and communicating the blowby storage space with the adjacent combustion chamber near the bottom of piston motion to recirculate blowby gases directly to the respective combustion chamber, said discharge passage means also being closed by the piston skirt during other positions of piston motion.

5. The combination of claim 4 wherein said discharge passage is a groove in the cylinder wall that bypasses the seal ring between the combustion chamber and blowby storage space when the piston is at the bottom position of its motion.

* * * * *

UNITED STATES PATENT AND TRADEMARK OFFICE

CERTIFICATE OF CORRECTION

PATENT NO. : 4,363,310

DATED : December 14, 1982

INVENTOR(S) : Kelly W. Thurston

It is certified that error appears in the above-identified patent and that said Letters Patent are hereby corrected as shown below:

Column 3, line 42, after "motion", "for" should read -- of --.

Column 3, line 50, "thid" should read -- third --.

Column 3, line 61, "escsape" should read -- escape --.

Column 3, line 63, "substanial" should read -- substantial --.

Column 4, line 17, "form" should read -- forms --.

Column 5, line 31, the numeral "62'" should read the numeral -- 62'' --.

Column 6, line 13, "Manfiold" should read -- Manifold --.

Column 6, line 29, "dischage" should read -- discharge --.

Column 6, line 35, "discharge. passages" should read -- discharge passages --.

Column 7, line 11, Claim 1, "scavening" should read -- scavenging --.

Column 7, line 17, Claim 1, "positined" should read -- positioned --.

Column 7, line 19, Claim 1, "pistion" should read -- piston --.

UNITED STATES PATENT AND TRADEMARK OFFICE

CERTIFICATE OF CORRECTION

PATENT NO. : 4,363,310

DATED : December 14, 1982

INVENTOR(S) : Kelly W. Thurston

It is certified that error appears in the above-identified patent and that said Letters Patent are hereby corrected as shown below:

Column 7, line 21, Claim 2, "acylinder" should read -- a cylinder --.

Column 8, line 15, Claim 2, after "position" insert -- of piston --.

Signed and Sealed this

*Twenty-sixth* Day of *April 1983*

[SEAL]

*Attest:*

GERALD J. MOSSINGHOFF

*Attesting Officer*

*Commissioner of Patents and Trademarks*